United States Patent [19]

Nehrbauer

[11] Patent Number: 4,887,664

[45] Date of Patent: Dec. 19, 1989

[54] HEAT EXCHANGER SYSTEM HAVING ADJUSTABLE HEAT TRANSFER CAPACITY

[75] Inventor: Joseph A. Nehrbauer, Orlando, Fla.

[73] Assignee: Westinghouse Electric Corp., Pittsburgh, Pa.

[21] Appl. No.: 130,045

[22] Filed: Dec. 7, 1987

[51] Int. Cl.[4] ..... F28F 7/00; F28F 27/02

[52] U.S. Cl. ..... 165/76; 165/101; 165/159

[58] Field of Search ..... 165/101, 76, 39, 40, 165/159

[56] References Cited

U.S. PATENT DOCUMENTS

| | | | |
|---|---|---|---|
| Re. 10,242 | 11/1882 | Mayer . | |
| 191,156 | 5/1877 | Kernochan . | |
| 266,979 | 11/1882 | Davis . | |
| 576,869 | 2/1987 | Lynn . | |
| 781,345 | 1/1905 | Kinnear . | |
| 817,287 | 4/1906 | Washburne . | |
| 1,851,765 | 3/1932 | Henshall . | |
| 1,908,733 | 5/1933 | Creel . | |
| 2,016,587 | 10/1935 | Beckman | 257/35 |
| 2,908,485 | 10/1959 | Longwell | 257/1 |
| 2,990,161 | 6/1961 | Blaskowski | 257/1 |
| 3,047,274 | 7/1962 | Wilson | 257/313 |
| 3,202,208 | 8/1965 | Geiringer | 165/40 |
| 3,367,409 | 2/1968 | Froelich | 165/40 |
| 3,586,101 | 6/1971 | Chu | 165/101 |
| 3,871,444 | 3/1975 | Houser et al. | 165/101 |
| 4,105,042 | 8/1978 | Johnston | 137/245 |
| 4,274,477 | 6/1981 | Nikolic | 165/101 |
| 4,589,478 | 5/1986 | Wunder | 165/76 |
| 4,593,527 | 6/1986 | Nakamoto et al. | 165/40 |
| 4,646,816 | 3/1987 | Rothstein | 165/76 |
| 4,765,374 | 8/1988 | Ermold et al. | 165/76 |

*Primary Examiner*—Henry A. Bennett
*Assistant Examiner*—Denise L. Ferensic

[57] ABSTRACT

A heat exchanger for a turbine generator power plant includes a plurality of heat transfer tubes for transferring heat from a primary fluid cooling system to a secondary water cooling system subject to variations in inlet temperature and the presence of emulsified particles. Upon a reduction in flow rate in the secondary system, as when accommodating a reduced inlet temperature, a reusable plug assembly comprising compression-actuated cap and plug members is installed on the ends of a selected portion of the heat transfer tubes to increase flow through the remaining heat transfer tubes and thereby reduce the tendency toward sedimentation of the impurities in the tubes. An alternative construction of the plug assembly allows the assembly to be installed with access to only one end of the heat transfer tubes.

16 Claims, 4 Drawing Sheets

FIG. 6
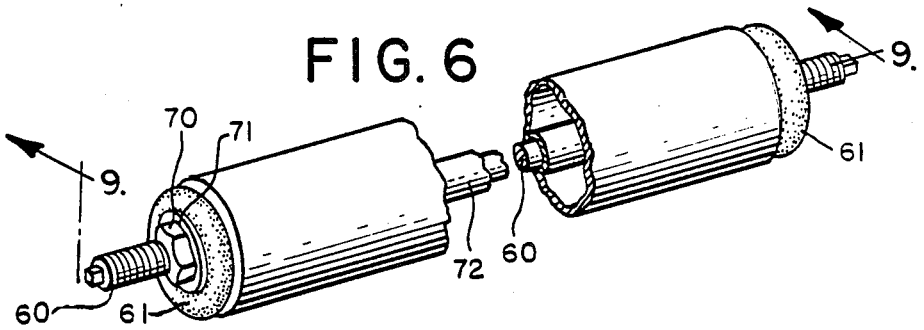
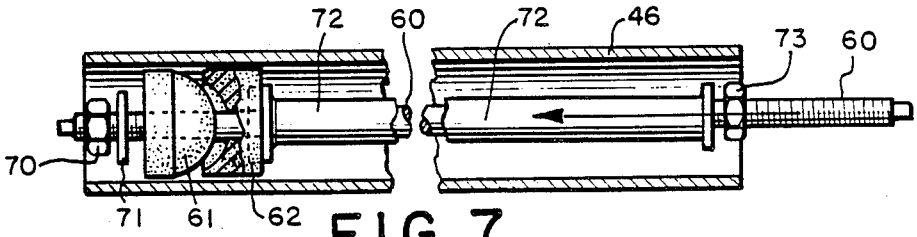
FIG. 7
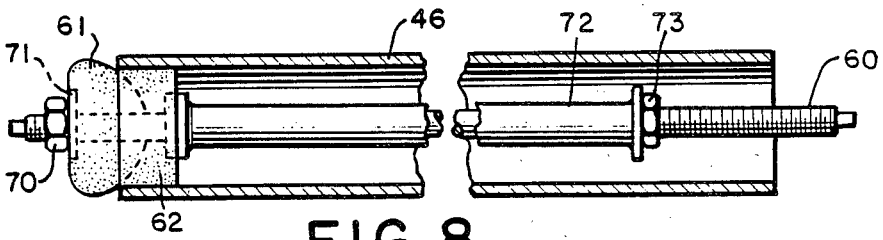
FIG. 8
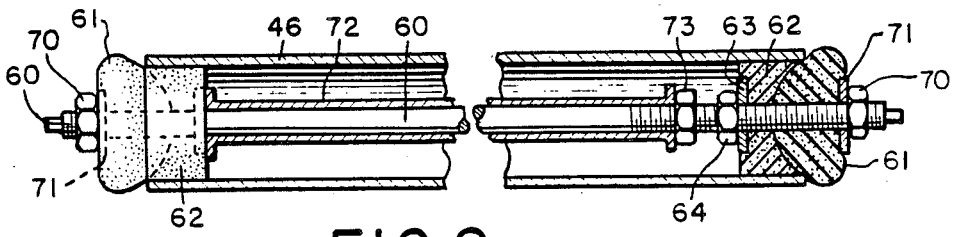
FIG. 9

HEAT EXCHANGER SYSTEM HAVING ADJUSTABLE HEAT TRANSFER CAPACITY

BACKGROUND AND DESCRIPTION OF THE INVENTION

The present invention is directed generally to heat exchangers for power generation systems, and more particularly to heat exchangers which use heat transfer tubes as a heat transfer boundary, such as those of tube and shell construction, for transferring heat from a primary to a secondary fluid circulation system; wherein, upon reduction in the flow rate in the secondary system, selected heat transfer tubes can be plugged to increase the fluid flow rate through the remaining heat transfer tubes for reduced sedimentation.

Heat exchangers are utilized in power generation systems for removing heat generated within turbine generator sets. Typically, such heat exchangers transfer heat between a primary purified fluid system which conveys heat from the generator set to the heat exchanger, and a secondary system which circulates cooling water, often containing emulsified particles and contaminants, to convey heat from the heat exchanger to an external pond, lake or cooling tower. Within the heat exchanger fluid from the secondary system is caused to flow through an array of parallel-spaced heat transfer tubes, and fluid from the primary system is caused to flow around the tubes so as to establish thermal communication between the two systems The heat transfer capacity of a heat exchanger in a power generation system must be sufficient to transfer a maximum heat load under the most unfavorable operating conditions, e.g., maximum supply temperature, minimum coolant flow, maximum fouling, etc. Consequently, heat exchangers for power systems are ordinarily over-designed to this condition, and have excess heat transfer capacity under more favorable conditions. In particular, a heat exchanger may have a greater number of heat transfer tubes than is required to achieve the necessary degree of heat exchange during normal system operating conditions. The excess heat transfer capacity of the extra tubes results in an undesirably low fluid flow rate through the tubes and a consequent increased tendency toward corrosion within the tubes.

This problem is particularly prevalent in northern climates where heat exchangers in power generation systems are exposed to wide variations in cooling water temperatures. As the inlet temperature of the cooling water drops the thermal driving force increases due to an increased fluid temperature difference, and as a result a lower flow rate is called for in the secondary system. If an undesirably low flow rate is established sedimentation and corrosion may occur in the heat transfer tube.

To eliminate excess heat transfer capacity and maintain a flow rate sufficient to avoid sedimentation in the heat transfer tubes the present invention contemplates plugging one or more of the heat transfer tubes, thereby forcing cooling water to pass through the remaining unplugged tubes at a higher velocity and reducing the tendency for sedimentation and corrosion. If at a later date increased cooling is required, the plugs can be removed and the associated heat transfer tubes returned to service. In essence, the isolated heat transfer tubes become installed spares.

For optimum performance, it is desirable that the tubes be plugged from both end-s and that the plugging be accomplished without modification to the heat exchanger or the heat transfer tubes. To this end, the present invention provides a plug assembly which includes compression-actuated sealing elements at each end of the tube which fluid-seal the open ends of the tube. In a preferred form, the compression-actuated sealing elements at each end include a cap member, which deforms over the open end of the tube, and a plug member, which deforms within the tube in cooperation with the cap member to tightly seal the tube. A spacing member in the form of an externally threaded rod extends the length of the heat transfer tube and through a central bore in the cap and plug members. This rod is fitted at each end with fastening means in the form of complementarily threaded machine nuts positioned to maintain the sealing elements at each end in compression.

In an alternative form of the invention where only one end of the heat transfer tube is accessible, the compression member is fitted with a sleeve at one end so that the cap and plug members at that end can be positioned at the inaccessible end of the heat transfer tube by sliding the members through the tube, after which the sleeve is utilized to force the plug member into compressive sealing engagement with the cap member at the inaccessible end by tightening a machine nut on the compression rod against the sleeve at the accessible end of the heat transfer tube.

SUMMARY OF THE INVENTION

The invention is directed to a heat exchanger system for transferring heat from a primary fluid circulation system to a secondary circulation system wherein the heat exchanger is subject to a variable heat transfer load, and the fluid in the secondary circulation system has a predetermined range of flow rates to accommodate the loads and includes impurities subject to sedimentation at reduced flow rates. The heat exchanger system comprises a heat exchange chamber, means including a plurality of heat transfer tubes extending through the chamber defining a flow path for fluid in the secondary circulation system, and means defining a flow path through the chamber for fluid in the primary circulation system whereby fluid in the primary system comes into thermal communication with the heat transfer tubes, and means for selectively plugging a portion of the heat transfer tubes whereby fluid flow through the remaining tubes is increased to reduce sedimentation of the impurities in the remaining tubes.

The invention is further directed to a plug assembly for plugging the ends of a heat transfer tube, wherein the assembly comprises a first plug member dimensioned to fit inside one end of the heat transfer tube, a first cap member at said one end adapted to radially expand into liquid-sealing engagement with the heat transfer tube upon compressive engagement with the first plug member, a second plug member dimensioned to fit inside the other end of the heat transfer tube, and a second cap member at the other end adapted to radially expand into liquid-sealing engagement with the heat transfer tube upon compressive engagement with the second plug member. Spacing means extending along the axis of the tube between the ends thereof are provided to engage the plug members to maintain a predetermined spacing therebetween, and means at each end are provided for drawing the members into compression with respective ones of the cap members to plug the heat transfer tube.

The invention is further directed, in a power generation system utilizing a source of cooling water containing emulsified particles and having a predetermined range of inlet temperatures for cooling a turbine driven generator, and requiring a predetermined heat transfer capacity for cooling the generator, to a heat exchanger system which comprises a heat exchanger housing, means within the housing defining a heat exchange chamber, means including a plurality of heat transfer tubes extending through the chamber defining a flow path for the cooling water, the tubes being subject to sedimentation of the emulsified particles in the cooling water with decreased flow rates in the flow path, and means defining a fluid recirculation system between the generator and the heat transfer chamber whereby heat is transferred to the cooling water as it flows through the heat transfer tubes. Means are provided for plugging a selected portion of the heat transfer tubes whereby the flow rate of cooling water through the remaining tubes is increased to reduce sentimentation within these tubes.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 6 is a perspective view of a heat transfer tube plug assembly installed on a heat transfer tube of the type which is accessible from one end only.

FIG. 7 is a cross-sectional view showing the insertion of the plug assembly of FIG. 6 into the heat transfer tube from the accessible end thereof FIG. 8 is a cross-sectional view of the plug assembly of FIG. 6 showing the assembly positioned prior to installation at the non-accessible end of the heat transfer tube.

FIG. 9 is a cross-sectional view showing the plug assembly in an installed condition on the heat transfer tube.

DESCRIPTION OF THE PREFERRED EMBODIMENTS

Figure 1:
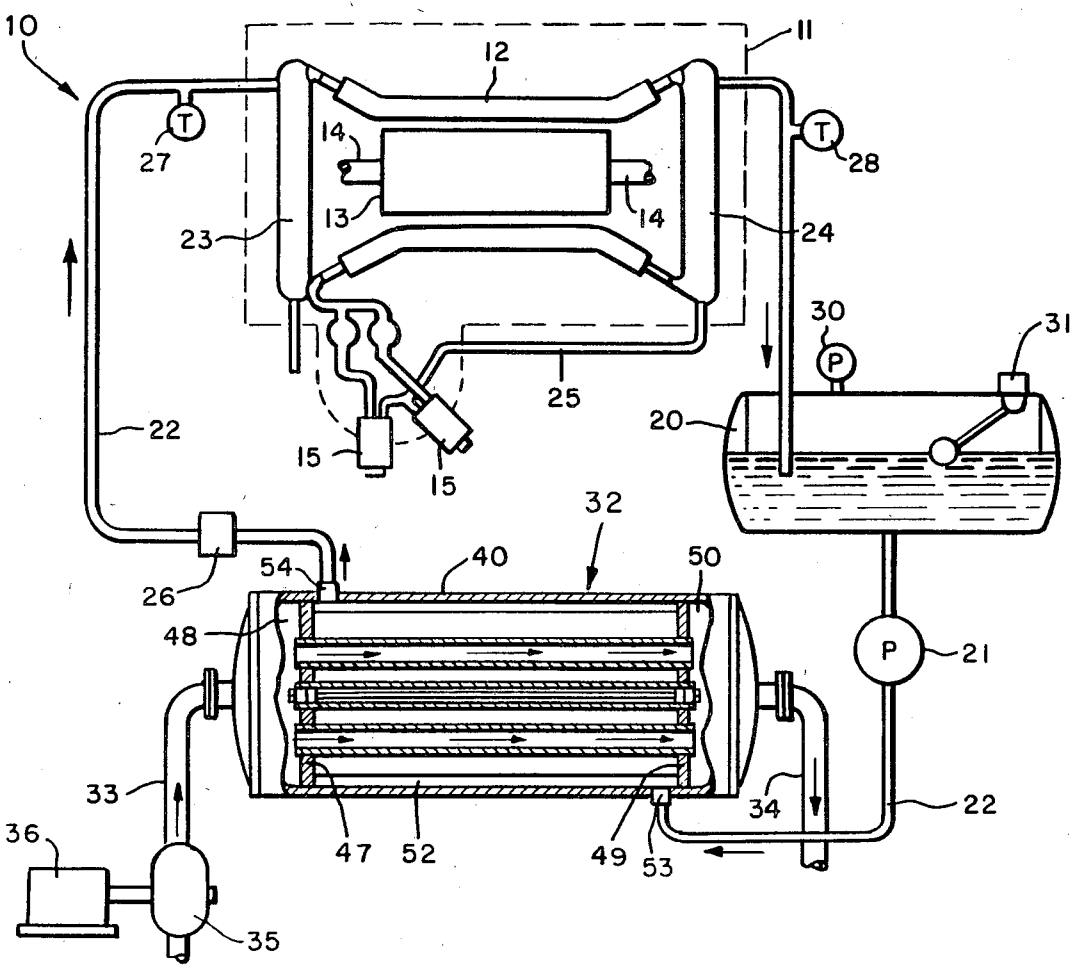
FIG. 1 is a simplified functional flow diagram of a cooling system for a turbine generator set wherein the system incorporates a heat exchanger constructed in accordance with the invention.

Referring to the drawings, and particularly to FIG. 1, a power generation system is seen to include a generator 11 of conventional design having a stationary stator 12 and a rotatably driven armature 13. A shaft 14 couples the armature at one end to a steam driven turbine (not shown) and at the other end to an exciter (not shown). Electrical communication is established with the windings of stator 12 by means of a plurality of electrical connections 15 extending through the generator housing.

To remove heat generated within generator 11 during operation, power generation system 10 includes, in accordance with conventional practice, a primary purified water circulation system which includes a reservoir 20, a pump 21 and a conduit system 22. Within generator 11 water in the primary system is distributed for circulation through stator windings 12 by an inlet manifold 23 and collected from the windings by an outlet manifold 24. A parallel flow path may be provided by a conduit 25 to remove heat generated at electrical connections 15. A conventional filter 26 may be provided in conduit system 22 to collect impurities circulating in the primary system.

The temperature of water in the primary circulation system may, in accordance with conventional practice, be monitored at the inlet to the generator by a first temperature sensing device 27, and compared on a continuous basis with the temperature of water at the outlet of the generator, as monitored by a second temperature sensing device 28. Insufficient cooling of the generator is indicated when the temperature at detector 28 exceeds a predetermined limit. The pressure in reservoir 20 may be monitored by a conventional pressure transducer 30 and the water level in the reservoir may be monitored by a conventional level detector 31.

To provide for cooling the circulating fluid in the primary cooling system, in accordance with conventional practice, a heat exchanger 32 which transfers heat from the primary circulation system to a secondary cooling system, within which circulates cold water derived from an external source, such as a cooling pond, lake or cooling tower. Such cooling water is admitted to heat exchanger 32 through an inlet conduit 33 and discharged from heat exchanger 32 through an outlet conduit 34. A conventional fluid pump 35 driven by an electric motor 36 may be provided to circulate cooling water in the secondary system. Variations in flow rate to obtain a desired heat transfer capability in the heat exchanger may be obtained by varying the operating speed of the pump.

Figure 2:
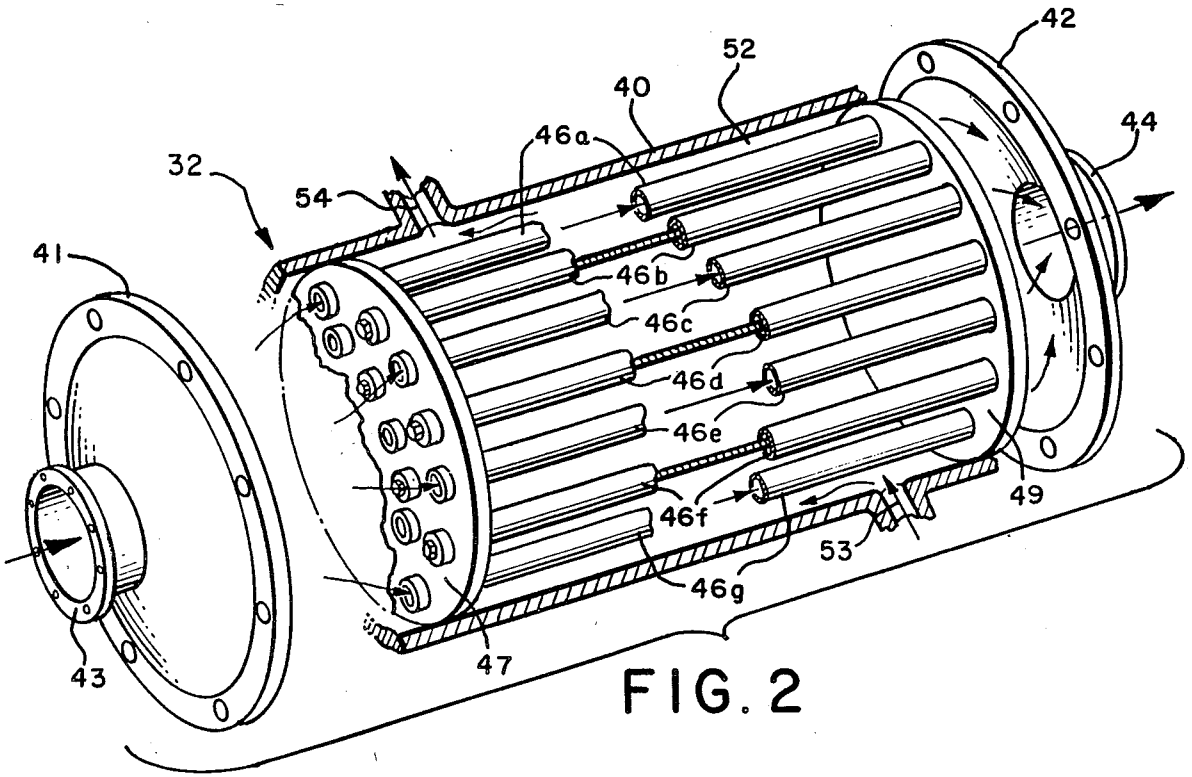
FIG. 2 is an enlarged perspective view, partially in section and partially fragmentary, of a heat exchanger constructed in accordance with the invention to incorporate a plurality of selectively plugged heat transfer tubes.

As shown in FIG. 2, heat exchanger 32 may, in accordance with conventional practice, comprise a generally cylindrical housing or shell 40 having detachable water chambers 41 and 42 at respective ends. Water chamber 41 may include a conventional fitting 43 for connection with inlet conduit 33, and water chamber 42 may include a conventional fitting 44 for connection with outlet conduit 34. With this arrangement, outside cooling water is admitted at one end and discharged at the other end of heat exchanger housing 40.

As shown in FIG. 2, heat exchanger 32 includes a plurality of heat transfer tubes **46*a*–46*g* which extend in parallel-spaced relationship within housing 40. Additional heat transfer tubes included in the heat exchanger are not shown for reasons of clarity. A baffle or tube sheet 47 within housing 40 forms a distribution chamber 48 (FIG. 1) at the inlet end of the heat exchanger so that cooling water entering through inlet 43 is distributed to heat transfer tubes 46*a*–46*g*. In the same manner, a tube sheet 49 forms a collection chamber 50 (FIG. 1) at the outlet end of the heat exchanger so that cooling water after passing through the heat transfer tubes is collected for discharge through outlet conduit 34**. The heat transfer tubes extend between and are supported by the tube sheets in accordance with conventional practice.

A heat exchange chamber 52 is formed between tube sheets 47 and 49 around the outside surfaces of the heat transfer tubes. Purified water in the primary circulation system is admitted to this chamber through an inlet port 53 in the sidewall of housing 40 and is withdrawn from the chamber through an outlet port 54 provided in the opposite side of the shell. Thus, water entering chamber 52 through port 53 is caused to circulate around the heat transfer tubes prior to exiting from the chamber through port 54. As a consequence of this circulation, heat from the purified water recirculating through chamber 52 is transferred to the cooling water flowing through the heat transfer tubes.

The capacity of the heat exchanger to transfer heat between the primary and secondary cooling systems depends on various factors, including, among others, the total surface area of the heat transfer tubes in use, the inlet temperature of the secondary cooling water, and the flow rate of the cooling water through the tubes. For a given heat load, a reduction in inlet temperature requires a slower flow rate through the tubes. The reduced flow increases the tendency for minerals and impurities present in the non-purified cooling water, such as emulsified paticles found in river water, to be deposited and accumulate on the sidewalls of the heat transfer tubes, which reduces heat transfer efficiency and forms sites at which corrosion may occur. Corrosion has been shown to lead to eventual tube failure, which requires shutdown of the unit for repairs. A faster flow rate reduces the tendency toward sedimentation.

Figure 3:
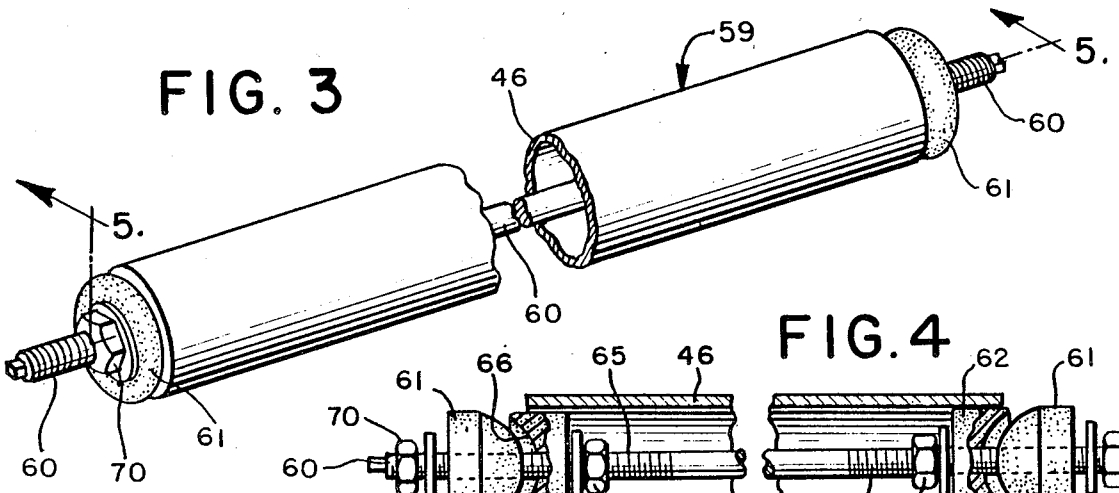
FIG. 3 is a perspective view of a heat transfer tube plug assembly installed in a heat transfer tube of the type which is accessible from both ends.
Figure 4:
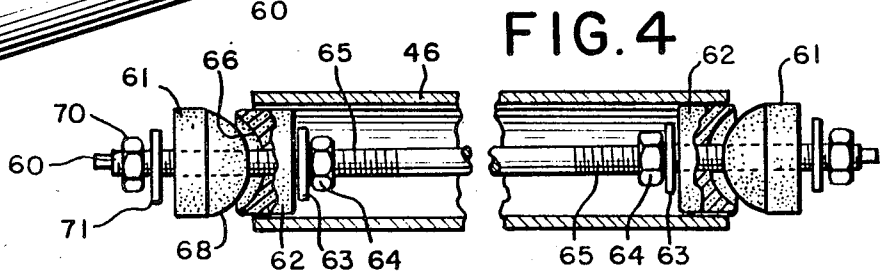
FIG. 4 is a cross-sectional view of the plug assembly of FIG. 3 showing the elements thereof prior to installation on the heat transfer tube.
Figure 5:
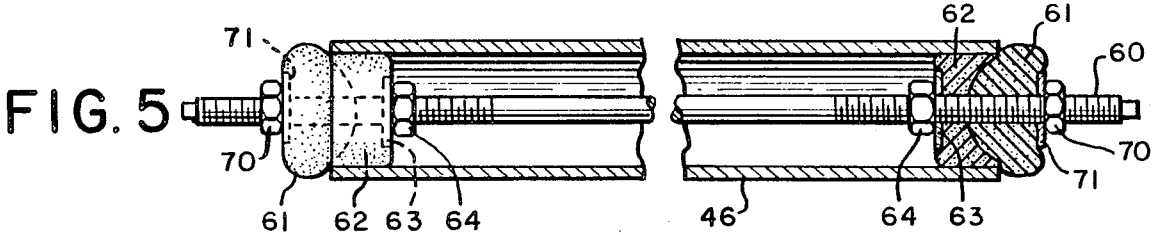
FIG. 5 is a cross-sectional view similar to FIG. 4 showing the elements of the plug assembly in an installed condition on the heat transfer tube.

Thus, where excess heat exchanger heat transfer capacity is present, (either because of over-design of the heat exchanger or because of a change in the inlet temperature of the cooling water) and the flow rate of the cooling water in the secondary system is reduced, sedimentation may occur in the heat transfer tubes of the heat exchanger. To avoid this condition, the invention provides for plugging the ends of a selected portion of the tubes. For example, in the embodiment illustrated in FIG. 2, heat transfer tubes 46*b*, 46*d* and 46*f* are plugged while heat transfer tubes 46*a*, 46*c*, 46*e* and 46*g* remain unplugged and active to convey cooling water between chambers 48 and 50. Since fewer heat transfer tubes are available for conveying water between chambers 48 and 50 the flow rate through the active heat transfer tubes 46*a*, 46*c*, 46*e* and 46*g* is increased, and the tendency for corrosion within these heat transfer tubes is reduced. Since the plugged tubes are plugged at both ends, no possibility exists for sedimentation within these tubes.

Where both ends of the heat transfer tubes are accessible, the heat transfer tubes may be efficiently plugged by means of the plug assembly (items 60 through 71) shown in association with a single heat transfer tube 46 in FIGS. 3–5. In particular, this assembly includes an axial spacing member in the form of a rod 60 which extends along the entire length and projects from the ends of tube 46. A fluid seal is obtained at each end of the tube by a two piece plug assembly consisting of a deformable cap sealing member 61, which is deformed by compressive engagement with a generally cylindrical plug sealing member 62 (FIGS. 4 and 5) positioned within the heat transfer tube, immediately adjacent the end thereof. Sealing members 61 and 62, which may be made of a deformable elastomeric material such as rubber, each include a central aperture through which rod 60 extends. Fastener means in the form of a washer 63 and nut 64 carried on the rod at each end over threaded portions 65 position plug member 62 in compressive engagement with cap member 61.

A concave outwardly facing engaging surface 66 on the plug member engages a convex inwardly-facing engaging surface 68 on the cap member. During installation, cap member 61 is positioned over rod 60 such that the convex engaging surface 68 is aligned with the concave engaging surface 66 of plug member 62. Additional fastener means in the form of a nut 70 and washer 71 are tightened on the threaded portion of rod 60 against cap member 61 at each end of the heat transfer tube to bring the sealing members into compressive engagement. The end of rod 60 may be machined to include flats for use in holding the rod stationary during tightening. The effect of the concave engaging surface 66 on the convex engaging surface 68 is to deform cap member 61 radially as shown in FIG. 5 such that the heat transfer tube is completely plugged and rod 61 is pinched to prevent leakage at the center of the plug. Nut 64 prevents plug member 62 from sliding back along rod 60 within heat transfer tube 46.

Where both ends of the heat transfer tube are accessible, cap and plug seating members are provided at both ends of each tube to be plugged. When, as shown in FIG. 5, nuts 70 have been tightened down at both ends the tube is completely liquid-sealed and inoperative for the purpose of conveying cooling water between chambers 48 and 50.

When only one end of the heat transfer tubes in a heat exchanger is accessible, or when it is desirable to gain access to only one end, the alternative construction for the plug assembly shown in FIGS. 6–9 can be utilized. In this construction, the nut 64 and washer 63 at the inaccessible end of the heat transfer tube are replaced by an elongated sleeve 72 which extends over rod 60 along the axis of the tube. A nut 73 is installed at the accessible end of the tube on the threaded portion 65 of rod 60.

During installation, a cap member 61 and a plug member 62, together with a nut 70 and washer 71, are assembled at the accessible end of the tube. These elements are then pushed, using the sleeve, as a unit from the accessible end along the axis of the tube to the inaccessible end, as shown in FIG. 7. When the sealing members are properly positioned at the inaccessible end, nut 73 is turned over the threaded portion 65 of rod 60 so as to compress members 62 and 67 between washer 71 and the abutting end of sleeve 72, as shown in FIG. 8. Next, a second set of sealing members 61 and 62 are installed on the accessible end of the heat transfer tube, with a nut 64 and washer 63 pre-positioned, and a nut 70 is tightened against a washer 71 to deform the cap and plug members as shown in FIG. 9. Thus, both ends of the heat transfer tube 46 are plugged, notwithstanding only one end of the tube being inaccessible.

A heat exchanger has been shown which is particularly well adapted for customizing a heat exchanger to the particular heat transfer requirements of a power generation system, and for accommodating changes in these heat transfer requirements, such as those which result from seasonal changes in the cooling water supply, while maintaining a flow rate through individual heat transfer tubes which minimizes clogging of the tubes. The heat exchanger incorporates individual plug assemblies which can be readily installed in selected heat transfer tubes to render these tubes inactive, thereby increasing flow in the remaining tubes, without modification to either the heat exchanger or the transfer tubes.

While particular embodiments of the invention have been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim as my invention:

1. A heat exchanger system for transferring heat from a primary fluid circulation system to a secondary fluid circulation system wherein said heat exchanger system is subject to variable secondary fluid inlet temperatures, and the fluid in said secondary circulation system has a predetermined range of flow rates to accommodate temperature fluctuations and includes impurities subject to sedimentation at reduced flow rates, said heat exchanger system comprising:

a heat exchanger chamber;

means including a plurality of heat transfer tubes extending through said chamber defining a flow path for fluid in said secondary circulation system;

means defining a flow path through said chamber for fluid in said primary circulation system whereby fluid in said primary system comes into thermal communication with said heat transfer tubes; and flow control means including a pair of plug members fitted on respective ends of each one of a selected portion of said heat transfer tubes and means for drawing said plug members together into supported liquid-sealed compression with said ends for selectively plugging said portion of said heat transfer tubes whereby fluid flow through the unplugged tubes is increased to reduce sedimentation of said impurities in said remaining tubes.

2. A heat exchanger system as defined in claim 1 wherein said fluid in said secondary circulation system comprises cooling water from an external source.

3. A heat exchanger system as defined in claim 3 wherein said primary fluid circulation system includes a substantially constant heat source and has a substantially constant flow rate.

4. A heat exchanger system as defined in claim 1 wherein said plug members are removable and reusable.

5. A heat exchanger system for transferring heat from a primary fluid circulation system to a secondary fluid circulation system wherein said secondary fluid circulation system is subject to a reduction in secondary fluid inlet temperature, and the fluid in said secondary circulation system includes impurities subject to sedimentation at reduced flow rates, said heat exchanger system comprising:

a heat exchanger chamber;

means including a plurality of heat transfer tubes extending through said chamber defining a flow path for fluid in said secondary circulation system;

means defining a flow path through said chamber for fluid in said primary circulation system whereby fluid in said primary system comes into thermal communication with said heat transfer tubes;

means for establishing a predetermined flow rate in said secondary fluid circulation system within a range of flow rates to accommodate said reduction in secondary inlet temperature; and flow means including a pair of plug members fitted on respective ends of each one of a selected portion of said heat transfer tubes and means for drawing said plug members together into supported liquid-sealed compression with said ends for selectively plugging said portion of said heat transfer tubes whereby fluid flow through the unplugged tubes is increased to reduce sedimentation of said impurities in said remaining tubes.

6. A heat exchanger system as defined in claim 5 wherein said fluid from said secondary circulation system is cooling water from an external source.

7. A heat exchanger system as defined in claim 6 wherein said primary fluid circulation system includes a substantially constant heat source and has a substantially constant flow rate.

8. A heat exchanger system as defined in claim 5 wherein said plug members are removable and reusable.

9. A heat exchanger system as defined in claim 1 wherein said flow control means comprise at each plugged heat transfer tube a first plug member dimensioned to fit inside one end of said heat transfer tube;

a first cap member at said one end adapted to radially expand into liquid-sealing engagement with said heat transfer tube upon compressive engagement with said first plug member;

a second plug member dimensioned to fit inside an other end of said heat transfer tube;

a second cap member at said other end adapted to radially expand into liquid-sealing engagement with said heat transfer tube upon compressive engagement with said second plug member;

spacing means extending along the longitudinal axis of said tube between the ends thereof and engaging said plug members to maintain a predetermined spacing therebetween; and means for drawing said plug members into compression with respective ones of said cap members to plug said heat transfer tube at each end thereof.

10. A heat exchanger system as defined in claim 9 wherein said plug and cap members are formed of a deformable elastomeric material.

11. A heat exchanger system as defined in claim 9 wherein said spacing means comprise a rigid rod member extending the length of the heat transfer tube, and first and second adjustable fastener means on said rod member for fixedly positioning said first and second plug members relative to said rod member, respectively.

12. A heat exchanger system as defined in claim 9 wherein end portions of said rod member extend beyond the ends of said tube, and said compression means comprise an adjustable fastener on each of said end portions.

13. A heat exchanger system as defined in claim 12 wherein said end portions of said rod member are threaded, and said compression means comprise user-adjustable nuts engaging said threads.

14. A heat exchanger system as defined in claim 9 wherein said spacing means further comprise a sleeve member extending over said rod member from said one end to said other end of said tube for engaging said plug member at said other end, and said first fastener means engages said first plug member and said second fastener means engages said sleeve member.

15. A heat exchanger system as defined in claim 14 wherein said fastener means comprise user-adjustable nuts threaded onto said rod member.

16. A heat exchanger system as defined in claim 9 wherein said plug member each include a concave engaging surface, and said cap members each include a convex engaging surface for engaging said concave surface of the associated one of said plug members.

* * * * *